United States Patent [19]

De Souza

[11] 4,190,946

[45] Mar. 4, 1980

[54] PROCESS FOR FABRICATION OF A CONSUMABLE METALLIC ELECTRODE

[75] Inventor: Jose D. De Souza, Sao Paulo, Brazil

[73] Assignee: Electrometal Acos Finos S. A., Brazil

[21] Appl. No.: 848,588

[22] Filed: Nov. 4, 1977

[30] Foreign Application Priority Data

Apr. 22, 1977 [BR] Brazil ..... 02533

[51] Int. Cl.[2] ..... B22D 11/126

[52] U.S. Cl. ..... 29/527.7; 13/18 R; 13/18 S

[58] Field of Search ..... 29/527.7, 527.5; 13/9 R, 18 R, 18 S; 313/352

[56] References Cited

U.S. PATENT DOCUMENTS

| | | | |
|---|---|---|---|
| 974,008 | 10/1910 | Wolff | 13/18 S |
| 1,067,031 | 7/1913 | Jewett | 13/18 R |
| 2,650,943 | 9/1953 | Leuchs et al. | 13/18 S |
| 3,378,622 | 4/1968 | Marin | 13/18 S |
| 3,787,336 | 1/1974 | Sharp | 13/18 R X |
| 3,975,577 | 8/1976 | Ramaccitte et al. | 13/18 R |
| 4,005,325 | 1/1977 | Suga | 13/18 R |
| 4,080,223 | 3/1978 | Schoerner et al. | 29/527.7 X |

*Primary Examiner*—Leon Gilden

*Attorney, Agent, or Firm*—Steinberg & Blake

[57] ABSTRACT

A process for the fabrication of a metal electrode having a vertical axis, composed of segments of two or more metal alloys of differing chemical compositions, these segments having masses and dimensions such that, after being joined to each other by various processes following an appropriately determined curve and junction surface, produce, after remelting by the Electroslag process, an ingot with a chemical composition which varies continuously along its axis, each chemical element varying in concentration along the axis according to a predetermined or arbitrarily selected equation. The ingot may be subjected to upset forging, metal blocks, slabs, flats, and plates and strips being obtained having chemical compositions which vary continuously along their thickness. By initially subjecting the obtained ingot to drawing with forging and/or rolling, bars, contour forgings and rings, with chemical composition varying continuously along their longitudinal axis, are obtained.

7 Claims, 6 Drawing Figures

PROCESS FOR FABRICATION OF A CONSUMABLE METALLIC ELECTRODE

The request for the patent in question refers to the process for the production of ingots with chemical composition varying continuously along their axis, using necessarily the technique of remelting of consumable electrodes by the Electroslag (ESR) process and, eventually, however not necessarily, followed by the Vacuum Arc Remelting (VAR) technique, both of public domain.

In the present descriptive report, the following definitions apply:

ESR stands for "Electroslag Remelting";

VAR stands for "Vacuum Arc Remelting";

ELECTRODE means any metallic piece, homogeneous or not, that can be remelted by either the ESR and VAR technique.

The most important phases of the process are the following:

1st phase: Fabrication of an electrode with vertical axis, composed of segments of two or more metals or metal alloys of different chemical compositions, these segments with forms and masses arbitarily selected and joined to each other in an appropriate configuration, either by welding process or by process of successive castings, or a combination of both.

The junction curve of the two metals M1 and M2 can have an arbitrary form, represented in FIG. 1 for simplicity by a polygon, DEFG, composed of three straight-line segments.

The component segments of the compound electrodes can be of any metal or metal alloy that is compatible with the ESR process, for example:

cast iron;

steels;

refractory alloys resistant to corrosion;

electrical and electronic alloys;

iron, nickel and cobalt based superalloys.

DESCRIPTION OF THE DRAWINGS

The invention will hereinafter be further described by way of example with reference to the accompanying drawings in which:

With reference to FIG. 1, which shows the compound electrode with its axis in the vertical position, that is, the position in which it will be remelted by the ESR process, we can observe the following:

Figure 2:
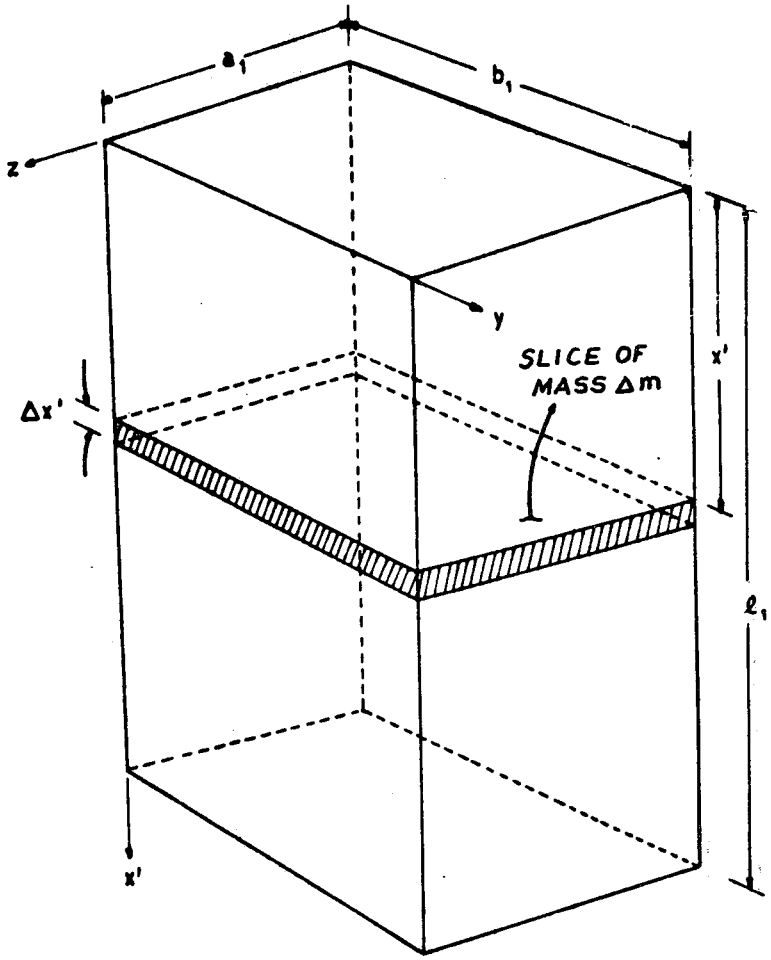
FIG. 2 is a schematic perspective view of an ingot produced from the electrode illustrated in FIG. 1 by remelting.

Each horizontal slice of height $\Delta x$ (sufficiently thin) and of mass $\Delta m$, situated in x in height l of the electrode, will produce in the ingot after remelting by the ESR process, a slice of height $\Delta x'$ and mass $\Delta m$ situated at x' at height $l_1$ of the ESR ingot (FIG. 2). This results from the particular mass transfer mechanism inherent in the ESR process.

As a consequence of the result described in the foregoing paragraph, all the chemical elements contained in the slice of the electrode will be contained in the corresponding slice with completely different distribution as will be shown later. In fact, there will be variations in the quantities of the elements, perfectly controllable, also inherent in the ESR process.

2nd phase: Remelting of the compound electrodes by the ESR process (FIG. 1), from which the secondary ESR remelted ingot is obtained (FIG. 2). The correspondence between the slice of the electrode and that of the ESR ingot located at x and x' of the respective heights from the respective bases, was established in the foregoing paragraphs, there being, however, several differences between these slices, among which are the following:

The slice of the electrode is not chemically homogeneous, while that of the ingot is, excepting for small differences related to the phenomenon of segregation, much reduced in the ESR ingots, but nevertheless still occurring.

Thus, the concentration of each chemical element can be considered constant within each horizontal slice of the ingot (however, it will vary continuously among adjacent slices) and is determined unequivocally by the fabrication process of the compund electrode. In other words, to clarify any eventual doubts:

(a) The concentration of each chemical element in each horizontal slice of the ingot is unequivocally defined by the manner in which the corresponding horizontal slice of the electrode was made up.

(b) Remelting by the ESR process homogenizes the concentration of each element in each horizontal slice.

The horizontal slice of the ingot will present, in relation to the corresponding slice of the electrode, better structure, better isotropy of mechanical properties, better macro and micro cleanness, occurrences inherent in the ESR process which do not have direct relationship with the present invention.

The distances x and x' of the corresponding electrode and ingot slices will be inversely proportional to the areas of their horizontal projections.

Another brief description of the invented process would be the following:

By various processes, a compound electrode with vertical axis is fabricated in such a way that the average chemical composition of its horizontal slices (chemically heterogeneous) of height $\Delta x$ (arbitrarily thin) varies in accordance with desired analytical functions.

This electrode is remelted by the ESR process, maintaining the variation of the average chemical composition of the horizontal slices according to the anlytical functions chosen at the time the electrode was fabricated. For reasons inherent in the ESR process, each slice is homogenized, so that the ingot thus obtained has a constant chemical composition in each horizontal section and a variable one, according to the analytical functions chosen, along its vertical axis.

ANALYTICAL PRESENTATION OF THE PROCESS

Figure 3:
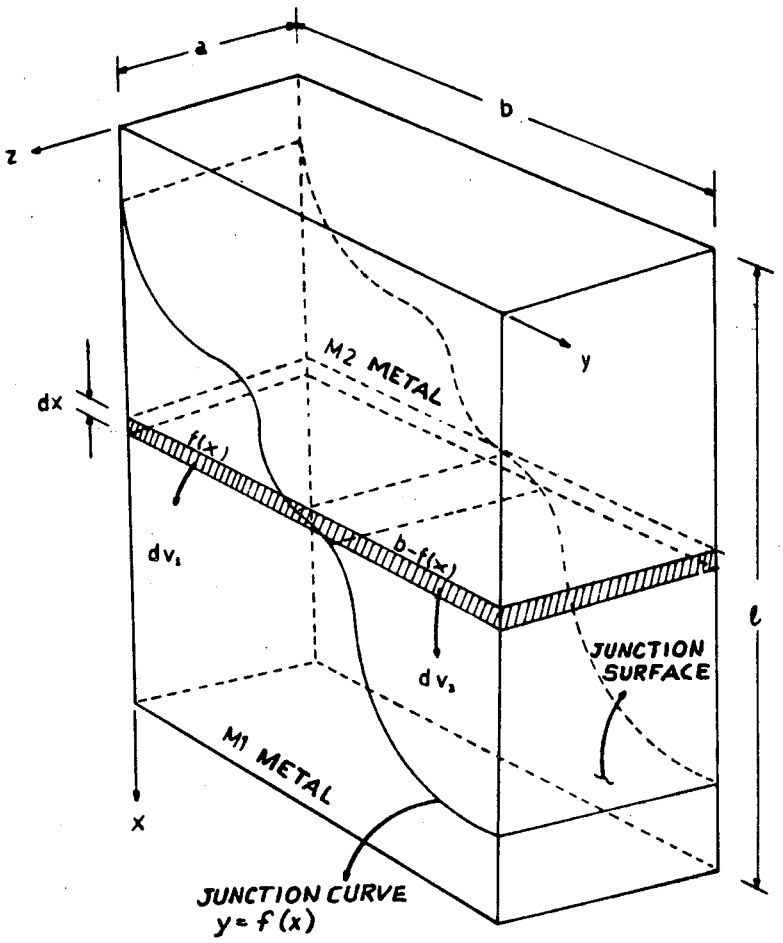
FIG. 3 is a schematic perspective view of an electrode prepared according to a further process according to the present invention.

With reference to FIG. 2 and FIG. 3, the following notation is established:

Mi=Metal or metal alloy type i;

M=Metal or metal alloy of the ESR ingot;

$E_{k,i}$=Percentage of concentration by weight concentration (weight percent) of the chemical element of order k in the metal or metal alloy type i;

$E_k(x')$=Percentage of concentration by weight concentration (weight percent) of the chemical element of order k in the metal of the ESR ingot in function of the variable x';

$\delta_1$=Density of M1;

$\delta_2$=Density of M2;

$\delta$=Density of M;

a=Thickness of slab, measured along axis z;

b=Width of slab, measured along axis y;

l=Length or height of slab, measured along axis x;

$a_1$=Thickness of ingot, measured along axis z;

$b_1$=Width of ingot, measured along axis y;

$l_1=l\cdot(a\cdot b/a_1\cdot b_1)$=length or height of ingot, measured along axis x'.

Thus, FIG. 3 represents an electrode composed of two metals, M1 (of order 1) and M2 (of order 2), joined to each other along an arbitrarily chosen function curve, y=f(x).

The compound electrode is represented as a parallelepiped by sides a, b and l, with its base at plane yz.

We will consider a horizontal slice of the electrode at height x having thickness dx. The following relationships are valid:

$$dV_1=a\cdot f(x)dx$$

$$dV_2=a[b-f(x)]dx$$

The masses of each element of order k in the volumes $dV_1$ and $dV_2$ are:

In $dV_1$:

$$E_{k,1}\cdot\delta_1\cdot dV_1 = E_{k,1}\cdot\delta_1\cdot af(x)dx \quad (1)$$

In $dV_2$:

$$E_{k,2}\cdot\delta_2\cdot dV_2 = E_{k,2}\cdot\delta_2\cdot a[b-f(x)]dx$$

In $dV_1+dV_2$:

$$E_{k,1}\cdot\delta_1\cdot af(x)dx + E_{k,2}\cdot\delta_2\cdot a[b-f(x)]dx$$

Due to the particular mass transfer mechanism inherent in the ESR process, there will be a one-to-one correspondence between the slice of the electrode with a height dx and at a distance x from its base and the slice of the ingot with a height $(ab/a_1\cdot b_1)\cdot dx$, situated at a distance $x'=x\cdot(ab/a_1\cdot b_1)$ from its base. The following relationship is valid in the slice of the ingot:

$$dV = a_1\cdot b_1\cdot\frac{ab}{a_1\cdot b_1}\cdot dx = ab\cdot dx$$

The mass of the chemical element of order k contained in the volume dV is:

$$E_k(x')\cdot\delta\cdot ab\cdot dx \quad (2).$$

Assuming the conservation of the mass of the element of order k during remelting, we have:

$$E_k(x')\cdot\delta\cdot ab\cdot dx = E_{k,1}\cdot\delta_1\cdot af(x)dx + E_{k,2}\cdot\delta_2\cdot a[b-f(x)]dx$$

Developing:

$$E_k(x') = \frac{f(x)}{b}\cdot\frac{\delta_1}{\delta}\cdot E_{k,1} + \left[1-\frac{f(x)}{b}\right]\cdot\frac{\delta_2}{\delta}\cdot E_{k,2} \quad (3)$$

$$E_k(x') = \varphi(x, E_{k,1}, E_{k,2}, \delta, \delta_1, \delta_2) \quad (3a)$$

Should the metals be sheets of types M1 and M2, it can be assumed that:

$\delta_1=\delta_2=\delta$, resulting in:

$$E_k(x') = \frac{f(x)}{b}\cdot E_{k,1} + \left[1-\frac{f(x)}{b}\right]\cdot E_{k,2} \quad (4)$$

$$E_k(x') = \psi(x, E_{k,1}, E_{k,2}) \quad (4a)$$

The concentration of the chemical element $E_k$ will be function of x' and will vary along that axis according to equations (3) and (4).

The problem which we have just solved analytically consisted of, after choosing arbitrarily two metals, M1 and M2, and the function y=f(x), determining the variation of the concentrations of the elements of order 1 up to k along the axis x' of the ESR ingot. The inverse problem, described below, involves more difficult mathematics, going beyond the purpose of this work, and will therefore not be discussed at length here. It consists of, after selecting an M1 metal and the variation curve of one arbitrarily chosen key-element Ei along the axis x' of the ESR ingot, determining the junction curve y=f(x), the chemical composition of the M2 metal, and the curves or functions $E_k(x')$, with $k\neq i$. We will indicate, only summarily, how to proceed in the particular case of $\delta_1=\delta_2=\delta$, when there is then a group of k equations, (4) (k=1, 2 . . . k). The following procedure for determining the parameters of the electrode is then employed. Select arbitrarily:

(a) One of the metals, M1 for example, with which are chosen $E_{k,1}$ (k=1, 2 . . . k).

(b) The concentration of the chemical element of order i in metal M2, Ei,2.

(c) The variation curve of the concentration of the element of order i, $E_i(x')$ along the axis x' of the ESR ingot.

The equation of order i from the group of equations (4) takes the form:

$$E_i(x') = \frac{f(x)}{b}\cdot E_{i,1} + \left[1-\frac{f(x)}{b}\right]\cdot E_{i,2} \quad (5)$$

Solving this equation for f(x), the equation of the junction curve of the metals M1 (known) and M2 (to be determined) is obtained:

$$f(x) = \frac{b[E_i(x') - E_{1,2}]}{E_{i,1} - E_{i,2}} \quad (6)$$

We are thus still free to choose arbitrarily the concentration of the elements of order k in the M2 metal, provided that $k\neq 1$. As in practice the M2 metal will be a standard alloy, the choice of $E_{i,2}$ determines, in fact, all the other $E_{k,2}(k\neq i)$ concentrations, so that, once these concentration values are known, the rest of the k−1 equations (4) can be solved and the k−1 functions $E_k(x')$ determined, where $k\neq i$.

DETAILS OF THE PROCESS

The process has been described in general lines and later studied analytically. We will now deal with the details of how the invented process is conducted.

Figure 4B:
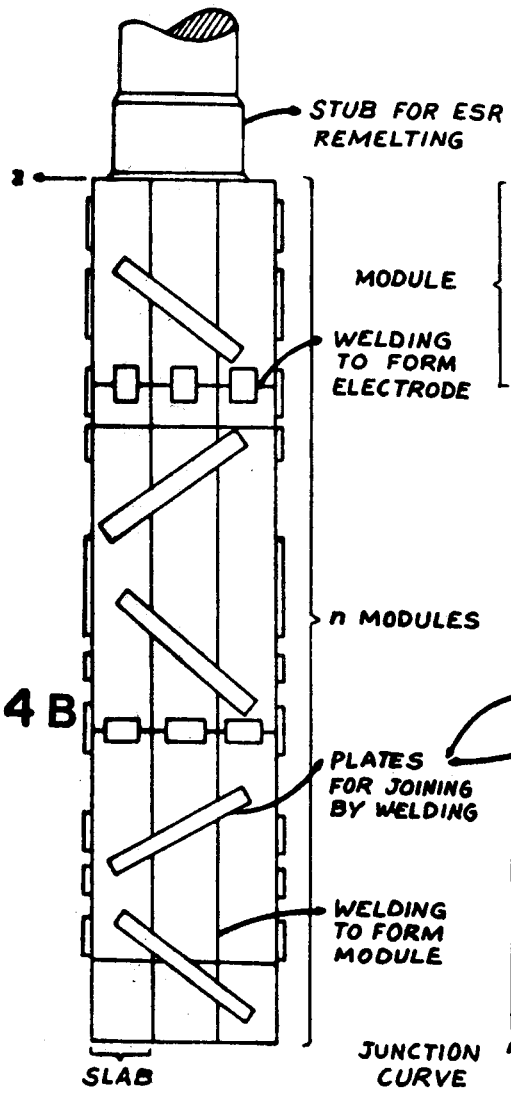
FIG. 4B is a side elevation view of the electrod illustrated in FIG. 4A.
Figure 4A:
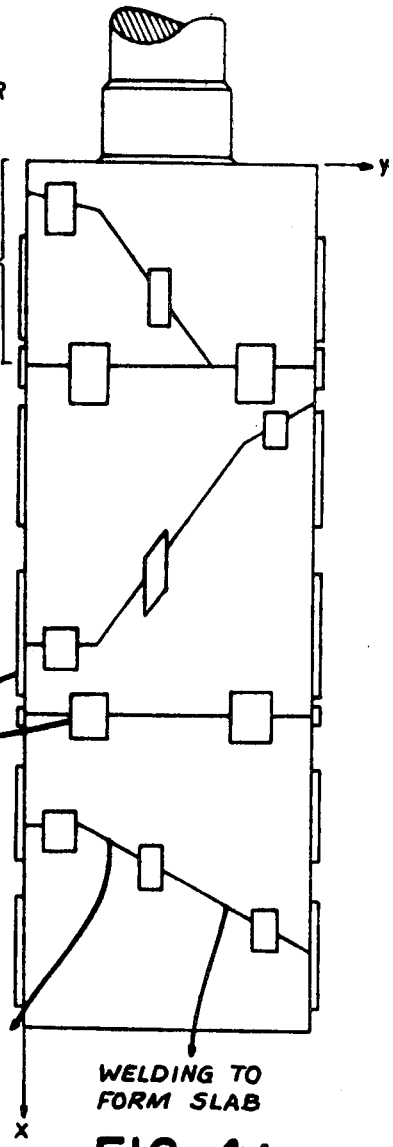
FIG. 4A is a front elevation view of the electrode illustrated in FIG. 1 prior to remelting.
Figure 4C:
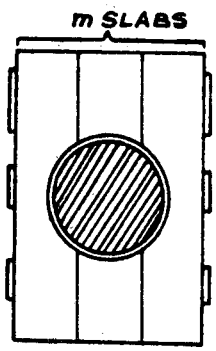
FIG. 4C is a plan view of the electrode illustrated in FIG. 4A illustrating the stub in cross-section.

Fabrication of the Electrode: FIGS. 4A, 4B, 4C, represent an electrode in its general form (except for the horizontal section which was considered rectangular), ready for remelting and already with the electrode stub welded.

Figure 1:
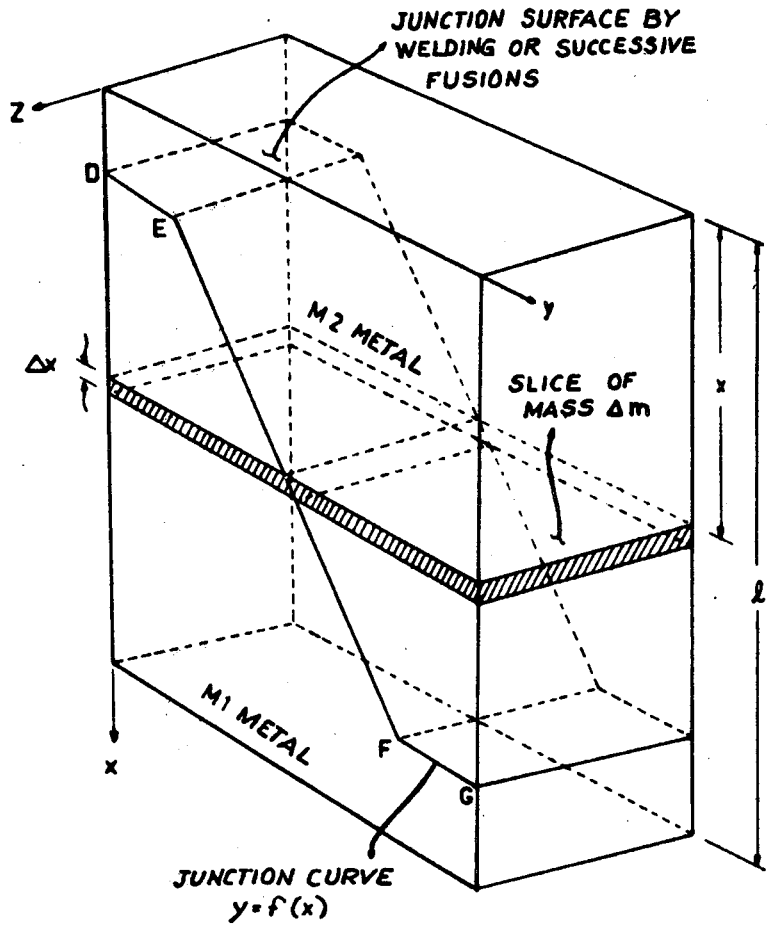
FIG. 1 is a schematic perspective view of an electrode prepared by a process in accordance with the present invention.

Definitions: The electrode may be composed of one or more modules, with each module consisting of one or more slabs. The following definitions apply:

(a) Slab: is the component of a module obtained by the joining of different metal segments along a defined curve (actually, along a curve contained in the xy plane or a surface in the space xyz). FIG. 1 can be considered a slab, or an electrode of a single module made up of a single slab. To form a module, a number m of slabs (m=1, 2 . . . m), which can be but are not necessarily the same as each other, are used.

(b) Module: is the solid, composed of one or more slabs containing in themselves metals M1 and M2 with chemical compositions, masses and configuration of junction (or junctions) which assure the obtainment, in the ESR remelted ingot, of the desired variation curves of the concentrations, along the axis x', of the various chemical elements. The modules will be called: simple, when consisting of a single slab; multiple, when consisting of two or more slabs. To form an electrode, a number n of modules (n=1, 2 . . . n), which can be but need not necessarily be the same as one another, are used.

(c) Electrode: We will now proceed to give a more restrictive definition of electrode. The following definitions, which are particular cases of that indicated initially, will henceforth be valid:

Primary Electrode: is the entire metallic piece subject to remelting by the ESR process and consisting of one or more modules, each of which contains in itself the metals M1 and M2 with chemical compositions, masses and configuration of junction (or junctions) which assure the obtainment, in the remelted ingot, of a corresponding module in which the concentrations of the chemical elements will vary along the axis x' according to preselected functions.

The primary electrode will be: monomodular, if consisting of a single module; polymodular, if consisting of more than one module.

Secondary Electrode: is that which is subjected to a second remelting by either the ESR or VAR process and composed of:

one ingot of the invented type, monomodular or polymodular (see definitions under d below), which has not been transformed by cold or hot working;

one or more ingots of the invented type, monomodular or polymodular, which have suffered transformation by cold or hot working.

(d) Ingots: The ingots of the invented type are products obtained by ESR remelting of a primary electrode or by ESR or VAR remelting of a secondary electrode. The ingot can be: monomodular, from the remelting of a monomodular electrode: polymodular, from the remelting of a polymodular electrode.

Fabrication of the Slab: With reference to FIG. 1, which represents either a slab or a simple monomodular electrode, the segments of the metals M1 and M2 allow three possible combinations depending on their origin:

Case 1—M1 and M2 both composed of forged or rolled slabs and cut according to a preselected junction curve by an applicable process, for example, oxi-acetylenic cutting, plasma cutting, etc.

Case 2—One of the metals is obtained by use of the process indicated in case 1, and the other, by casting in a mould shaped so as to guarantee the obtainment of the preselected function curve (or surface).

Case 3—M1 and M2 both obtained by casting in a mould as indicated in case 2.

The junctions of the segments of metals M1 and M2 can be made in the following ways:

In case 1: By direct electric welding along the junction curves and/or by welding of junction plates as shown in FIGS. 4A, 4B, 4C.

In case 2: there are two alternatives: 1st alternative: As in case 1. 2nd alternative: Set the rolled or forged metal segment, already cut according to the junction curve, in a mould for casting as if it were a core, and cast the rest of the slab with the other type of metal. It is necessary to leave in the rolled or forged slab special devices in order to assure its union with the metal to be cast. These devices can be simple recesses or welded protrusions, or both.

In case 3: There are two alternatives: 1st alternative: As in case 1. 2nd alternative: As in the second alternative of case 2, with the difference that the metal segment to be used as the core would be cast instead of forged or rolled.

Fabrication of the Module: When the module is simple, composed of a single slab, its fabrication is confounded with that of the slab. When the module is multiple, that is, composed of two or more slabs, assembling is made by electrical or other appropriate welding along the junctions of the slabs as indicated in FIGS. 4A, 4B, 4C. Welding does not have to be continuous. Welded junction plates may also be used to help the joining of the slabs as indicated in FIGS. 4A, 4B, 4C.

Fabrication of the Electrode: When the electrode is monomodular, its fabrication is confounded with that of the module. When it is polymodular, the modules are joined to one another by electric or other appropriate welding along the intermodular junctions. Welding does not have to be continuous. Welded Junction plates may also be used to aid in the joining of the modules to each other as shown in FIGS. 4A, 4B, 4C.

Remelting of the ESR Ingot: Shapes of the ingots: The ingot obtained from the remelting of a primary electrode can have a circular, square or rectangular section. In practice, for reasons connected with the fabrication of the electrode, the ingots will preferably be rectangular or square. Ingots with a ring-shaped section can be obtained by simultaneously remelting various secondary electrodes arranged along a circle and using the appropriate ingot moulds.

Refining Procedure: By the ESR remelting process, the electrode is transformed into an ingot with chemical composition varying continuously along its axis according to arbitrarily selected curves. In the ESR process, an electric current of high intensity passes through the circuit in series constituted by the electrode, liquid slag bath and ingot in formation and maintains the temperature of the slab higher than the melting temperature (liquidus) of the steel. Consequently, the end of the electrode immersed in the slag bath melts gradually, with the formation of successive drops of steel which, after going through the slag bath, will solidify at the lower part, thus forming the ESR ingot. The thermochemical and physical reactions between the slag bath, the film of liquid steel at the end of the electrode and at the top of the ingot in formation, as well as with the descending steel drops, "refine" steel, eliminating or reducing drastically the total volume of inclusions and controlling the dimensions, form and distribution of the remaining insignificant fraction. There is also, in the ESR process, elimination of the segregation and reduction in the anisotropy of the mechanical properties, all these benefits being inherent in the ESR process in itself and not deliberately sought in this invention but which inevitably occur.

To mark on the ESR ingot the cross-sections corresponding to the junctions between the modules, in the case of polymodular electrodes, the remelting current is interrupted by a small interval of time (normally 30 to 60 seconds) whenever the fusion front attains the intermodular limits. This forms a tiny dent on the ESR ingot along the cross-section at the moment in which the current is interrupted, marking, on the invented ingot, the separation between the modules. There are several practical ways to determine the moment in which to interrupt the current.

Control of the Invented Ingot: After cooling, the ingot is or is not subjected to heat treatment, depending on the alloys in the M1 and M2 metals. It is then submitted to control by ultrasonics to mark the croppings at the foot and top of the ingot. If the ingot is monomodular, the cropping of the foot and top discards results in the semi-product ready for later industrialization. If polymodular, it is also cut along the marks obtained with the interruption of the remelting current to indicate the separation of the various modules, each of which represents, in actuality, an ingot of the type invented.

The advantage of producing polymodular ingots is only economic, to improve the yield and the efficiency of the ESR remelting unit.

Products Obtained from the Invented Ingot: Each ingot of the invented type, or each module in the case of polymodular ingots, must be processed by forging, using one of the following three alternatives:

(a) Forging by upsetting: By upsetting the invented ingot, the height $l_1$ shown in FIG. 2 is reduced, with the consequent increase of dimensions $a_1$ and $b_1$, according to a known relationship. From this, then, are obtained: blocks, slabs, flats. During and/or after the upsetting operation, the section form, for example, can be changed from rectangular to square or circular or vice-versa by forging.

Taking into consideration that the chemical composition will vary continuously along the x' axis (FIG. 2) in the ingot, these semi-products will have corresponding variation of chemical composition along their thickness. Subsequent transformation of these blocks, slabs or flats by rolling will lead to the obtainment of plates, sheets and strips with variation in continuous chemical composition, also along their thickness. In this manner, if the invented ingot is upset, products with varying chemical composition in a continuous manner along their thickness will be obtained. These products are blocks, slabs, flats, plates, sheets and strips.

(b) Forging by drawing: Forging the invented ingot by drawing increases the height $l_1$ indicated in FIG. 2 and correspondingly diminishes the dimensions $a_1$ and $b_1$ according to a known relationship. During this forging, the shape of the cross-section can also be arbitrarily changed. From this, then, are obtained: bars, contour forgings and rings (in the case of rings, obtained from annular ingots). These products will then have their chemical composition varying continuously along their length.

(c) Combined forging: Obviously, forgings can be made by combining upsetting with drawing, from which are obtained pieces with complex forms of continuous variation in the chemical composition within their masses.

Applications: The process is very prolific in application, and we will mention but a few examples:

(a) Armour Plates: The process permits the obtainment of theoretically and practically perfect armour plates with continuous variation of the following parameters:

(a') hardness, ultimate and yield strength; descreasing, from front to back;

(b') resilience, elongation and reduction in area; increasing, from front to back.

(b) Clad Steel Plates: The plates obtained through the invented process represent an extraordinary advance over clad steel plates because, in reality, they correspond to plates composed of an infinite number of parallel sheets (instead of two) with chemical composition (and, consequently, mechanical properties) varying continuously, in the case of conventional clad steel, there is a sudden transition between the two hot-joined metals becase the phenomenon of difusion is of very limited penetration and variable for the different chemical elements, disadvantages which are completely eliminated with the invented process. The conventional "clad" can be fabricated by the invented process merely by considering the curve $y=f(x)$ in FIG. 3 as a segment of a straight line, with small slope in relation to the y axis; the smaller the slope, the smaller will be the transition layer (corresponding to that of difusion, in this case equal for all the chemical elements).

A product equivalent to the "clad" of three metals, however with much superior properties, can also lasily be fabricated.

The most significant applications for these clad plates would be for: the nuclear industry, chemical industry, petrochemical industry, oil industry.

Note that as the invented process employs the ESR and VAR techniques, the materials obtained are inherently of highest reliability and hence can be applied safely in the nuclear industry.

I claim:

1. A process for the manufacture of a metal ingot having a chemical composition varying continuously along its axis, comprising the steps of: fabricating a metallic electrode by joining at least one pair of metallic segments of different chemical composition along a junction surface which follows a curve defined by an arbitrarily chosen equation, said segments having respective predetermined masses and dimensions, and remelting said electrode by the electroslag process to form an ingot having a chemical composition varying continuously along its axis, the concentration of each chemical element varying along an axis according to an equation defined by the manner in which the electrode is fabricated.

2. A process as claimed in claim 1 comprising the further step of predetermining the characteristics of the electrode as a function of the desired variation of the chemical composition of the ingot according to the following procedure:

(a) arbitrarily choosing the metallic material of one of the segments and selecting the concentrations, designated $E_{k,1}$ of each of the k chemical elements in this material;

(b) arbitrarily choosing the concentrations, designated $E_{i,2}$, of the i chemical elements of the metallic material of the other one of the segments;

(c) selecting the variation curve along the axis x' of the ingot of the chemical element of order i, designated $E_i(x')$, of the remelted metal ingot;

(d) determining the junction equation between the segments using the following equation:

$$f(x) = \frac{b[\delta E_i(x') - \delta_2 E_{i,2}]}{\delta_1 E_{i,1} - \delta_2 E_{i,2}},$$

where f(x) is the junction equation, $\delta_1$, $\delta_2$ and $\delta$ are the densitites of the two starting metals and of the metal of the ingot produced, respectively, and b is the dimension of the ingot in the direction in which the junction surface, described by f(x), is made;

(e) determining concentrations $E_{k,2}$, $k \neq i$, are determined, or a standard grade with $E_{i,2}$ as chosen previously is selected, determining $E_{k,2}$ with $k \neq i$; and (f) repeating the steps (a) to (e) for all other pairs of adjacent metal segments.

3. A process as claimed in claim 2 in which the electrode is composed of segments of two or more metals or metal alloys of different chemical compositions, so as to produce after remelting by the Electroslag process, an ingot with chemical composition varying continuously along its axis.

4. A process as claimed in claim 1 further comprising the step of remelting the electrode by the Electroslag process to produce a metal ingot.

5. A process as claimed in claim 4 including the step of subjecting the metal ingot to upset forging along the axis of the ingot or stretch forging and/or rolling so as to produce metal blocks, slabs, flats, plates or strips, with chemical composition varying continuously along their thickness.

6. A process as claimed in claim 4 including the step of subjecting the metal ingot to hot and/or cold deformation, by drawing, with forging and/or rolling so as to produce metal bars, contour forgings or rings, with chemical composition varying continuously along their longitudinal axis.

7. A process as claimed in claim 4 including the step of subjecting the metal ingot to combined hot and/or cold deformation, upsetting and/or drawing, with forging and/or rolling, so as to produce metal bodies of any form, with chemical composition varying in any form, with chemical composition varying continuously in their interior.

* * * * *